US010156084B2

(12) United States Patent
Garcia

(10) Patent No.: US 10,156,084 B2
(45) Date of Patent: Dec. 18, 2018

(54) PRIVACY STRIP AND PRIVACY TIP APPARATUS

(71) Applicant: Darin Michael Garcia, Poway, CA (US)

(72) Inventor: Darin Michael Garcia, Poway, CA (US)

(73) Assignee: Darin Garcia, Poway, CA (US)

( * ) Notice: Subject to any disclaimer, the term of this patent is extended or adjusted under 35 U.S.C. 154(b) by 0 days.

(21) Appl. No.: 15/927,371

(22) Filed: Mar. 21, 2018

(65) Prior Publication Data

US 2018/0209168 A1 Jul. 26, 2018

Related U.S. Application Data

(63) Continuation-in-part of application No. 15/344,523, filed on Nov. 6, 2016, now Pat. No. 9,963,904.

(51) Int. Cl.
*E04H 17/14* (2006.01)
*E04B 1/26* (2006.01)

(52) U.S. Cl.
CPC ..... *E04H 17/1434* (2013.01); *E04B 1/2604* (2013.01); *E04B 2001/2644* (2013.01)

(58) Field of Classification Search
CPC ..... E04H 17/1426
USPC ..... 428/81
See application file for complete search history.

(56) References Cited

U.S. PATENT DOCUMENTS

2016/0244992 A1* 8/2016 Presti ..... E04H 17/1421
2017/0073996 A1* 3/2017 Russo ..... E04H 17/143

* cited by examiner

*Primary Examiner* — Brent T O'Hern

(57) ABSTRACT

A privacy strip covering a middle viewable opening between two boards within privacy fence. The privacy strip is affixed along a backside of a privacy fence and wedged in between the top stringer and the bottom stringer while covering the middle viewable opening. A top privacy tip configured to cover a top viewable opening. A bottom privacy tip configured to cover a bottom viewable opening between two fence boards. A single piece privacy strip configured to cover an entire viewable opening between a first fence board and an adjacent second fence board within an installed privacy fence. The privacy strip, tips, and single piece privacy strip being adjustable in length and allow for attachment onto fence boards or stringers for installation.

3 Claims, 12 Drawing Sheets

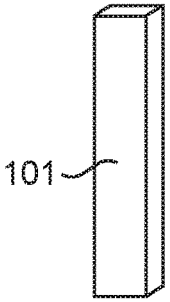
FIG. 1A
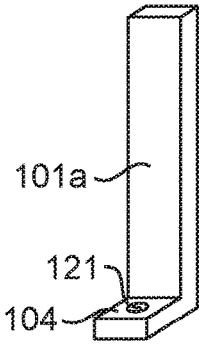
FIG. 1B1
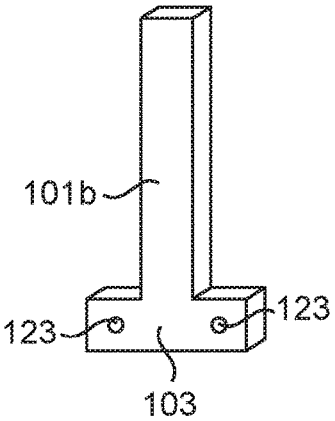
FIG. 1B2
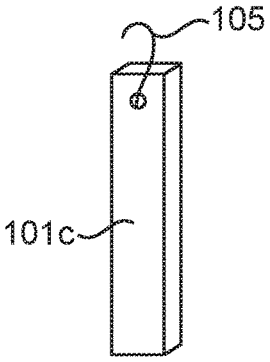
FIG. 1B3

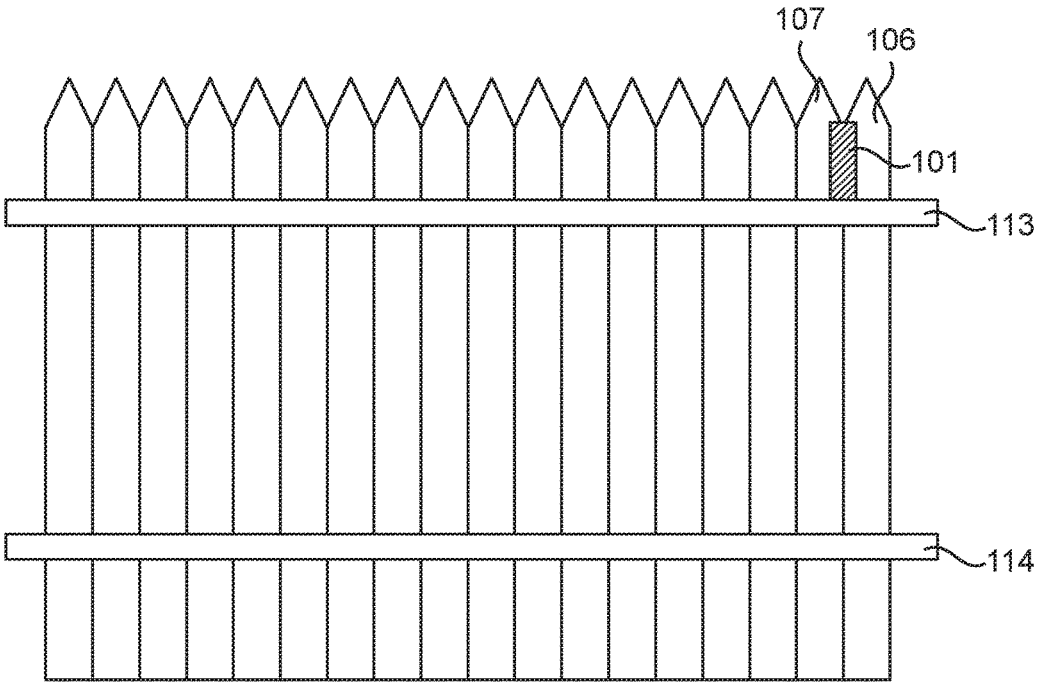
FIG. 1C
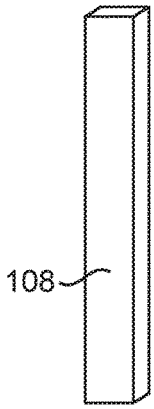
FIG. 1D1
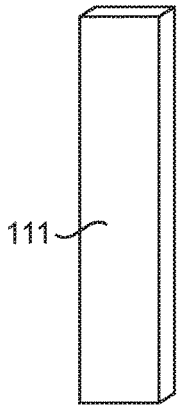
FIG. 1D2

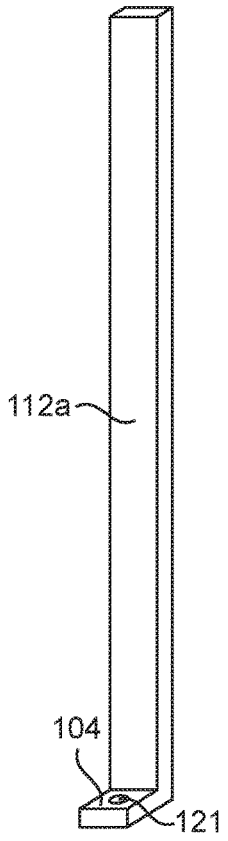
FIG. 2B1
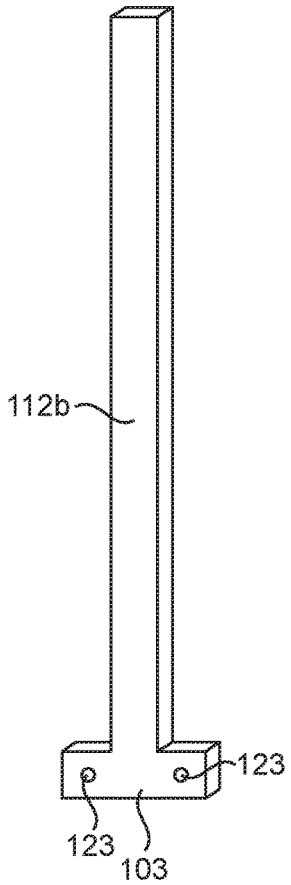
FIG. 2B2
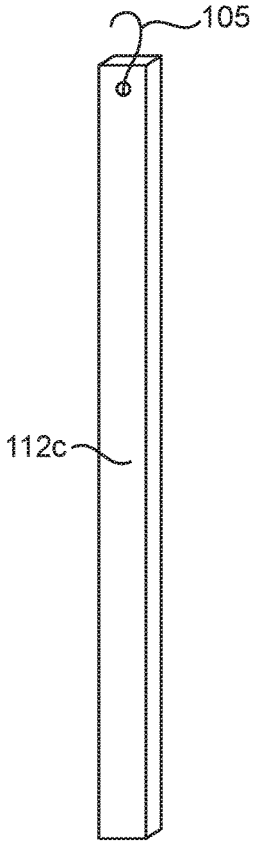
FIG. 2B3

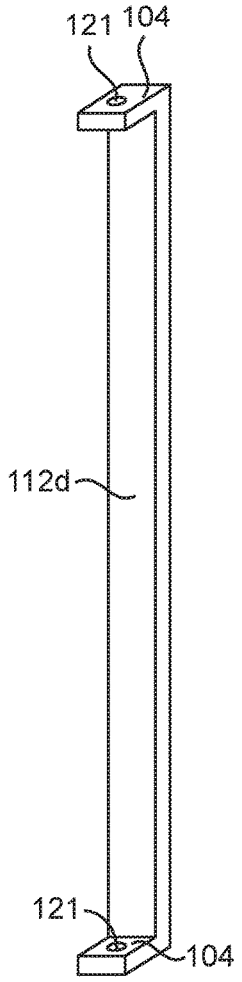
FIG. 2C1
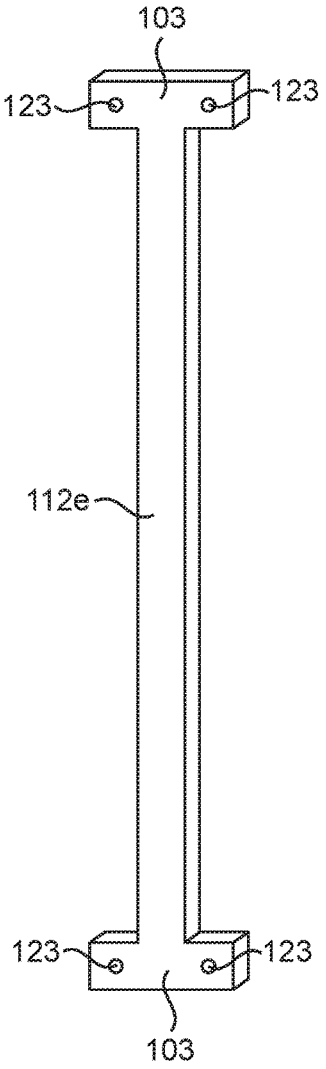
FIG. 2C2
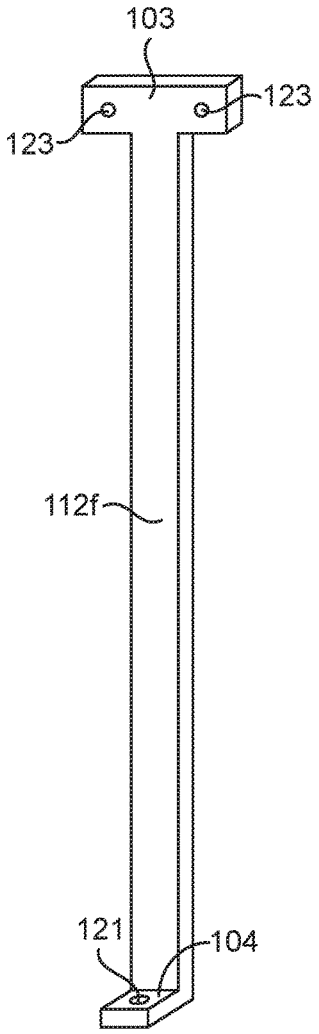
FIG. 2C3

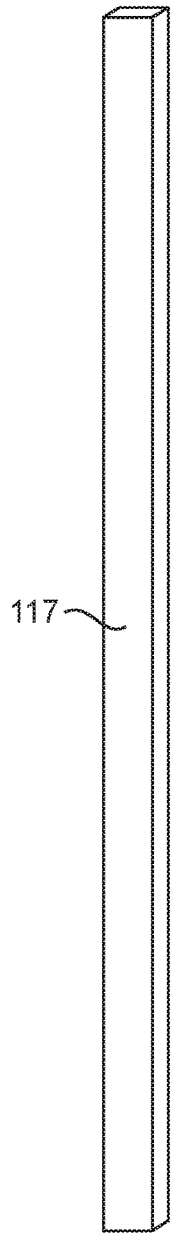
FIG. 4
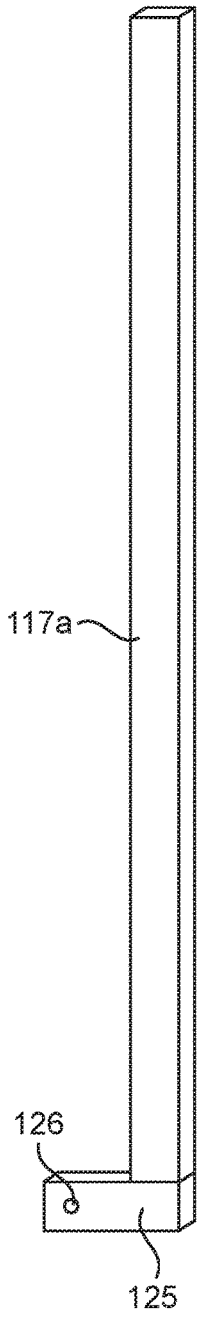
FIG. 4B1
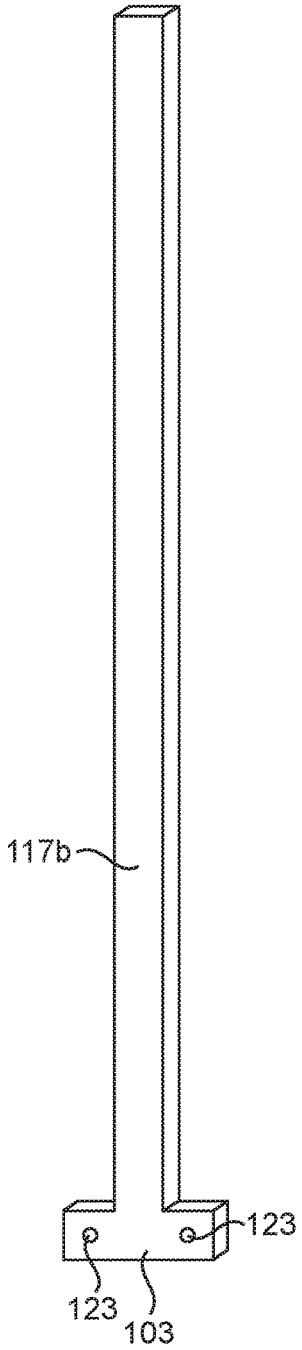
FIG. 4B2

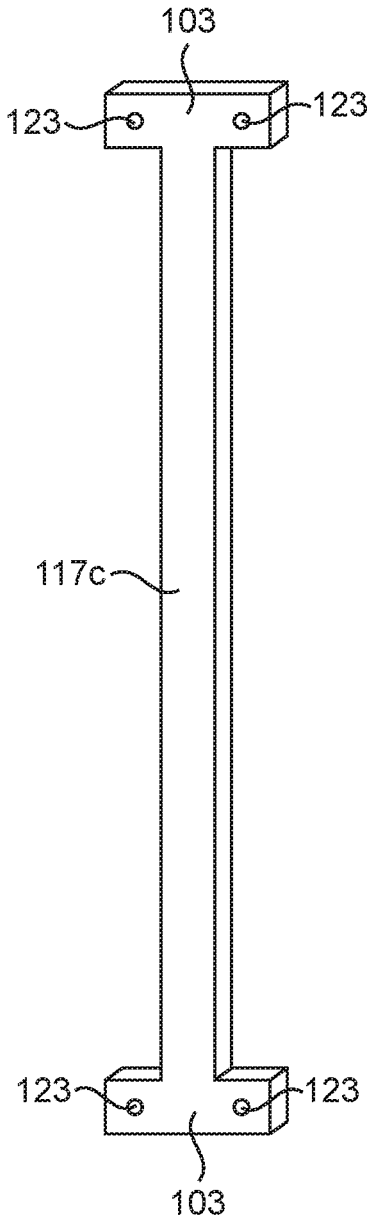
FIG. 4C1
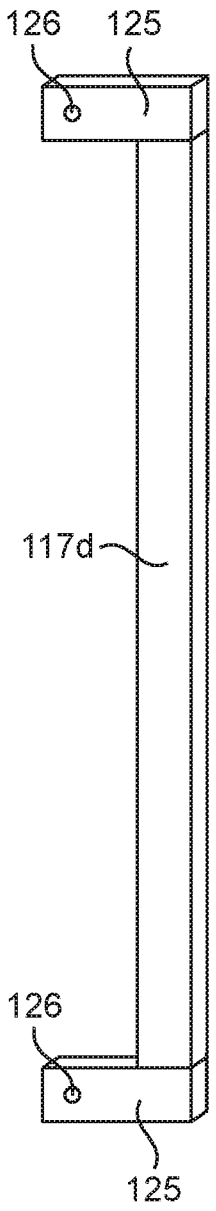
FIG. 4C2

PRIVACY STRIP AND PRIVACY TIP APPARATUS

CROSS REFERENCE TO RELATED APPLICATIONS

This application is a Continuation-In-Part application of an earlier filed non-provisional patent application earlier filed on Nov. 6, 2016 having application Ser. No. 15/344,523, titled "Privacy Strips/Privacy Tips", granted to Garcia on May 8, 2018, U.S. Pat. No. 9,963,904, which is incorporated by reference in its entirety.

FIELD OF INVENTION

The field of invention is privacy fencing accessories, specifically, strips which can be applied to gaps maintained within privacy fencing.

BACKGROUND

The concept of building privacy fences to delineate boundaries with neighbors and also provide a level of privacy for both parties has been known and understood for some time. The concept of building wood or plastic privacy fences that measure 6 to 10 feet tall in order to keep neighbors from looking into each other's yard is relatively understood. The challenges that exist in having a privacy fence installed on your property include that it's not as private as you might like, there are gaps in between fence boards that allows your neighbor to see into your property. A need therefor exists to have enhance level of privacy within an existing or newly installed residential privacy fence.

SUMMARY

A privacy strip and privacy tip configured to be attached to a privacy fence to provide more complete privacy for the end user. A traditional privacy fence is comprised of a horizontal top beam, a horizontal bottom beam, and a plurality of parallel vertical pickets arranged in a sequential manner. A top privacy tip is configured to be placed in front of the gap created between two neighboring pickets, resting on top of the horizontal top beam, with either the top, bottom, or both ends of the privacy tip wedged, placed, or fastened, or bendable and bowed out upon insertion in between the two neighboring pickets or a top of the horizontal top beam.

Similarly, a bottom privacy tip is configured to be placed in front of the gap created between two neighboring pickets, resting on bottom of the horizontal bottom beam, with either the top, bottom, or both ends of the privacy tip wedged, placed or fastened, or bendable and bowed out upon insertion in between the two neighboring pickets or a bottom of the horizontal bottom beam. Moreover, in an alternative embodiment, the bottom privacy tip may be configured to be placed in front of the gap created between two neighboring pickets by being mounted into the cement ground, soil, grass, or the dirt ground.

The privacy strip may be configured to be placed in front of the gap created between two neighboring pickets, occupying the space between the horizontal top beam and the horizontal bottom beam, with either the top, bottom, or both ends of the privacy strips wedged, placed or fastened, or bendable and bowed out upon insertion in between the two neighboring pickets or in between a bottom of the horizontal top beam and a top of the horizontal bottom beam.

In an alternative embodiment, a single piece privacy strip may be a full-length strip configured to be placed in front of the gap that covers the entire length of the gap created between two neighboring pickets, on the side opposite the horizontal beams, wherein the strip can be cut in length or thickness to a desired sizing and may be attached by wedging the single piece privacy strip at any point between the gap created between the two neighboring pickets. The bottom privacy tip, the top privacy tip, the privacy strip, and the single piece privacy strip can be cut (or resized) in length or thickness to a desired sizing by the consumer.

The single piece privacy strip, the bottom privacy tip, the top privacy tip, and the privacy strip may have at least one attachment point configured along its body or endpoints adapted to allow for attachment by attachments means, such as, nails, screws, adhesive, hooks, etc. The attachment endpoint may be a T-bracket, or L-bracket, or any variation of a bracket or hook mechanism available and known in the art. In an alternative embodiment, rather than cutting down the privacy tip, privacy strip, or single piece privacy strip, the consumer may elect to collapse the body, length wise, in a foldable manner, to allow for perfect sizing.

The single piece privacy strip, the bottom privacy tip, the top privacy tip, and the privacy strip may be comprised of plastic, vinyl, plastic, aluminum, steel, foam, mendable/bendable plastic materials, or other suitable materials available and known in the art. The single piece privacy strip, the bottom privacy tip, the top privacy tip, and the privacy strip may be comprised of varying or differing colors. The single piece privacy strip, the bottom privacy tip, the top privacy tip, and the privacy strip may be varying shapes (cylindrical, rectangular, triangle, square, etc.) known in the art. The privacy tips and privacy tips should not be limited to the drawings presented, but rather are contemplated to be of varying lengths, width, and heights suitable for usage by a consumer. In one embodiment of the disclosure, the bottom privacy tip or the top privacy tip may be 10 inches (or reasonable size) to allow a consumer to cut it, if necessary, and still provide added privacy. In one embodiment of the disclosure, the privacy strip may be 5 feet (or reasonable size) to allow a consumer to cut it, if necessary, and still provide added privacy. In one embodiment of the disclosure, the single piece privacy strip may be 10 feet (or reasonable size) to allow a consumer to cut it, if necessary, and still provide added privacy. In one embodiment, the thickness of the single piece privacy strip, the bottom privacy tip, the top privacy tip, and the privacy strip may range between 1/16 of an inch, and up to 1 inch.

BRIEF DESCRIPTION OF DRAWINGS

These and other features will not be described with reference to the drawings summarized below. These drawings and the associated description are provided to illustrate a preferred embodiment of the invention, and not to limit the scope of the invention.

FIG. 1A is an illustration of an exemplary top privacy tip without a fastener mechanism.

FIG. 1B1 is an illustration of an exemplary top privacy tip with an L-bracket fastener mechanism.

FIG. 1B2 is an illustration of an exemplary top privacy tip with a T-bracket fastener mechanism.

FIG. 1B3 is an illustration of an exemplary top privacy tip with a J-hook fastener mechanism.

FIG. 1C is an illustration of an exemplary privacy fence back side showing an installed top privacy tip.

FIG. 1D1 is an illustration of an exemplary top privacy tip having a square shape.

FIG. 1D2 is an illustration of an exemplary top privacy tip having a rectangle shape.

FIG. 1D3 is an illustration of an exemplary top privacy tip having a circular shape.

FIG. 1D4 is an illustration of an exemplary top privacy tip having a triangular shape.

FIG. 2B1 is an illustration of an exemplary privacy strip with an L-bracket fastener mechanism.

FIG. 2B2 is an illustration of an exemplary privacy strip with a T-bracket fastener mechanism.

FIG. 2B3 is an illustration of an exemplary privacy strip with a J-hook fastener mechanism.

FIG. 2C1 is an illustration of an exemplary privacy strip with two L-bracket fastener mechanisms.

FIG. 2C2 is an illustration of an exemplary privacy strip with two T-bracket fastener mechanisms.

FIG. 2C3 is an illustration of an exemplary privacy strip with a T-bracket and L-bracket fastener mechanisms.

FIG. 3B1 is an illustration of an exemplary bottom privacy tip with an L-bracket fastener mechanism.

FIG. 3B2 is an illustration of an exemplary bottom privacy tip with a T-bracket fastener mechanism.

FIG. 3B3 is an illustration of an exemplary bottom privacy tip with ground stake fastener mechanism.

FIG. 4 is an illustration of an exemplary single piece privacy strip without a fastener mechanism.

FIG. 4B1 is an illustration of an exemplary single piece privacy strip with an L-bracket fastener mechanism.

FIG. 4B2 is an illustration of an exemplary single piece privacy strip with a T-bracket fastener mechanism.

FIG. 4C1 is an illustration of an exemplary single piece privacy strip with two T-bracket fastener mechanisms.

FIG. 4C2 is an illustration of an exemplary single piece privacy strip with two L-bracket fastener mechanisms.

DETAILED DESCRIPTION

Figure 2A:
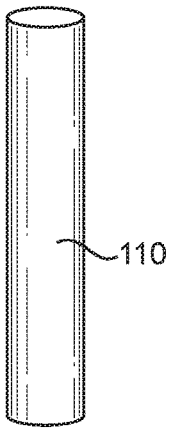
FIG. 2A is an illustration of an exemplary privacy strip without a fastener mechanism.
Figure 2A:
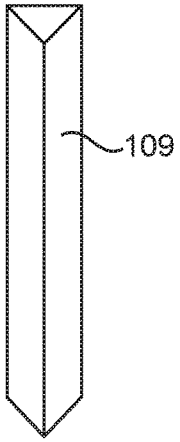
Figure 2A:
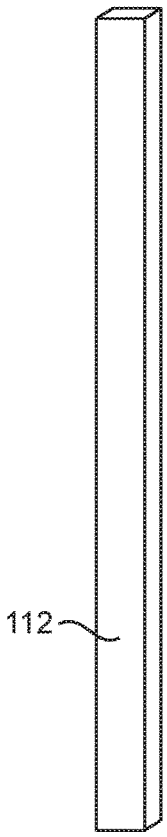

Specific embodiments of the invention will now be described with reference to the drawings. These embodiments are intended to illustrate, and not limit, the present invention. For example, although the specific embodiment described herein involve a privacy fence having vertical aligned fence boards and two horizontal support beams, the invention is also applicable to other types of privacy fencing, including privacy fencing installed wherein the fence boards are arranged in a horizontal manner, rather than vertical, or wherein there are multiple horizontal support beam, rather than two support beams shown in the illustrations.

FIG. 1A is an illustration of an exemplary top privacy tip without a fastener mechanism. The top privacy tip 101 may be comprised of plastic, vinyl, aluminum, steel, wood, or any other suitable material known in the art. The top privacy tip 101 may be of a suitable thickness, width and length suitable to cover the gap created between two pickets within a privacy fence, as shown in FIG. 1C. The top privacy tip 101 may have no fastener mechanism, and may be suitable for inserting at a downward angle (i.e. wedged) between the inner gap created in between the vertical pickets and a top surface of a horizontal top beam. Alternatively, the top privacy tip may be fastened onto at least one horizontal beam or at least one picket by means of adhesive along its surface area in order to be affixed into position.

FIG. 1B1 is an illustration of an exemplary top privacy tip with an L-bracket fastener mechanism. The top privacy tip with an L-bracket fastener mechanism 101*a* may have a L-bracket 104 integrated along its bottom portion to allow for a nail, screw, or suitable alternative to be inserted into the L-bracket hole 121 within the L-bracket 104. The L-bracket 104 is suitable to be affixed to the horizontal top beam 113, as shown in FIG. 1C, to hold the top privacy tip with a L-bracket 101*a* in place.

FIG. 1B2 is an illustration of an exemplary top privacy tip with a T-bracket fastener mechanism. The top privacy tip with a T-bracket fastener mechanism 101*b* may have a T-bracket 103 integrated along its bottom portion to allow for a nail, screw, or suitable alternative to be inserted into the T-bracket holes 123 within the T-bracket 103. The T-bracket is suitable to be affixed to the right picket 106 and left picket 106, as shown in FIG. 1C, to hold the top privacy tip with T-bracket 101*b* in place.

FIG. 1B3 is an illustration of an exemplary top privacy tip with a J-hook fastener mechanism. The top privacy tip with a J-hook fastener mechanism 101*c* may have a J-hook 105 integrated along its upper portion to allow for a hooking along a top portion of at least one neighboring picket, to hold the top privacy tip with J-hook fastener mechanism 101*c* in place.

FIG. 1C is an illustration of an exemplary privacy fence back side showing an installed top privacy tip. The privacy tip may be installed between two parallel pickets and resting on a top horizontal beam. In one embodiment, a right privacy picket 106 and a left privacy picket 107, when installed, have a gap created between them, that can be filled or covered by the top privacy tip 101, wherein the privacy tip 101 can be wedged at a downward angle along the horizontal top beam 113, to hold the top privacy tip 101 in place.

FIG. 1D1 is an illustration of an exemplary top privacy tip having a square shape. In one exemplary embodiment, the privacy tip having a square shape 108, may be suitable.

FIG. 1D2 is an illustration of an exemplary top privacy tip having a rectangle shape. In one exemplary embodiment, the privacy tip having a rectangle shape 111, may be suitable.

FIG. 1D3 is an illustration of an exemplary top privacy tip having a circular shape. In one exemplary embodiment, the privacy tip having a circular shape 110, may be suitable.

FIG. 1D4 is an illustration of an exemplary top privacy tip having a triangular shape. In one exemplary embodiment, the privacy tip having a triangular shape 109, may be suitable. In this embodiment, a pointed edge of a triangle may be inserted into the gap created between two neighboring pickets to provide additional security. Moreover, the same shape as shown in FIG. 1D4 for triangle, may be fabricated for privacy strip, bottom privacy tip, or a single piece privacy strip.

Figure 2D:
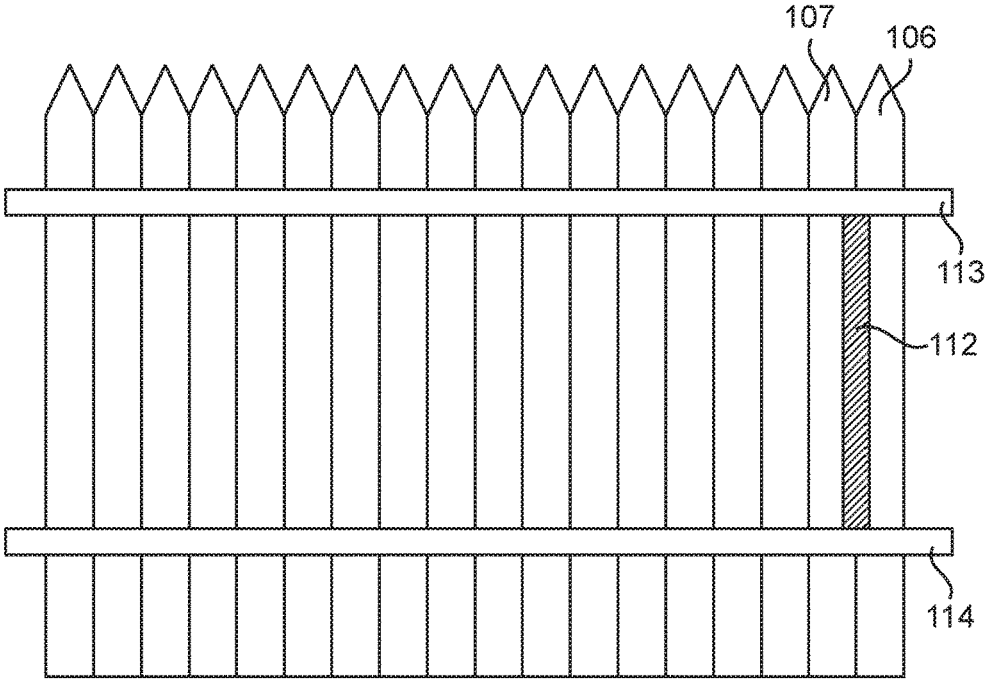
FIG. 2D is an illustration of an exemplary privacy fence back side showing an installed privacy strip.

FIG. 2A is an illustration of an exemplary privacy strip without a fastener mechanism. The privacy strip 112 may be comprised of plastic, vinyl, aluminum, steel, wood, or any other suitable material known in the art. The privacy strip 112 may be of a suitable thickness, width and length suitable to cover the gap created between two pickets within a privacy fence, as shown in FIG. 2D. The privacy strip 112 may have no fastener mechanism, and may be suitable for affixing in between the two horizontal beams, as shown in FIG. 2D. In one embodiment, the privacy strip may be wedged into an inner gap that exists between the top surface of a bottom horizontal beam and two vertical neighboring pickets. In another embodiment, the privacy strip may be wedged into an inner gap that exists between the bottom surface of a top horizontal beam and two vertical neighboring pickets. Alternatively, the privacy strip may be fastened onto at least one horizontal beam or at least one picket by means of adhesive along its surface area in order to be affixed into position.

FIG. 2B1 is an illustration of an exemplary privacy strip with an L-bracket fastener mechanism. The privacy strip with an L-bracket fastener mechanism 112*a* may have a L-bracket 104 integrated along its bottom or top portion to allow for a nail, screw, or suitable alternative to be inserted into the L-bracket hole 121 within the L-bracket 104. The L-bracket 104 is suitable to be affixed to the horizontal top beam 113 or the horizontal bottom beam 114, as shown in FIG. 2D, to hold the privacy strip with a L-bracket 112*a* in place.

FIG. 2B2 is an illustration of an exemplary privacy strip with a T-bracket fastener mechanism. The privacy strip with an T-bracket fastener mechanism 112*b* may have a T-bracket 103 integrated along its bottom or top portion to allow for a nail, screw, or suitable alternative to be inserted into the T-bracket hole 123 within the T-bracket 103. The T-bracket 103 is suitable to be affixed to the horizontal top beam 113 or the horizontal bottom beam 114, as shown in FIG. 2D, to hold the privacy strip with a T-bracket 112*b* in place.

FIG. 2B3 is an illustration of an exemplary privacy strip with a J-hook fastener mechanism. The privacy strip with an J-hook fastener mechanism 112*c* may have a J-hook 105 integrated along its top portion to allow for the J-hook 105 to attach to a top portion of a horizontal top beam 113 to hold the privacy strip with a J-hook fastener mechanism 112*c* in place.

FIG. 2C1 is an illustration of an exemplary privacy strip with two L-bracket fastener mechanisms. The privacy strip with a dual L-bracket fastener mechanism 112*d* may have a L-bracket 104 integrated along its bottom and another L-bracket integrated along its top portion to allow for a nail, screw, or suitable alternative to be inserted into the L-bracket hole 121. The top L-bracket 104 is suitable to be affixed to the horizontal top beam 113 and the bottom L-bracket is suitable to be affixed to the horizontal bottom beam 114 to hold the privacy strip with dual L-bracket 112*d* in place.

FIG. 2C2 is an illustration of an exemplary privacy strip with two T-bracket fastener mechanisms. The privacy strip with a dual T-bracket fastener mechanism 112*de* may have a T-bracket 103 integrated along its bottom and another T-bracket integrated along its top portion to allow for a nail, screw, or suitable alternative to be inserted into the T-bracket hole 123. The top T-bracket 103 is suitable to be affixed to the horizontal top beam 113 and the bottom T-bracket is suitable to be affixed to the horizontal bottom beam 114 to hold the privacy strip with dual T-bracket 112*e* in place.

FIG. 2C3 is an illustration of an exemplary privacy strip with a T-bracket and L-bracket fastener mechanisms. The privacy strip with a T-bracket and L-bracket fastener mechanism 112*df* may have a L-bracket 104 integrated along its bottom and another T-bracket 103 integrated along its top portion, or the reverse. The top T-bracket 103 may be suitable to be affixed to the horizontal top beam 113 and the bottom L-bracket may be suitable to be affixed to the horizontal bottom beam 114 to hold the privacy strip 112*e* in place. If flipped, the T-bracket 103 may be suitable to be affixed to the horizontal bottom beam 114 and the L-bracket may be suitable to be affixed to the horizontal top beam 113 to hold the privacy strip 112*e* in place.

FIG. 2D is an illustration of an exemplary privacy fence back side showing an installed privacy strip. In one embodiment, a right picket 106 and a left privacy picket 107 are installed in a parallel manner and a gap is created between their affixed positions that requires covering. The privacy strip 112 is intended to be fitted between the top horizontal beam 113 and the bottom horizontal beam 114, to cover up the gap that exists between the two pickets. The privacy strip 112 may be manually inserted by an end user in between the two horizontal beams and tightly affixed by friction or by wedging the privacy strip along its opposite ends along the horizontal beams.

Figure 3A:
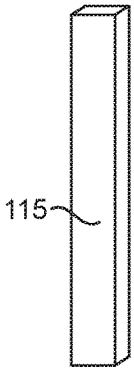
FIG. 3A is an illustration of an exemplary bottom privacy tip without a fastener mechanism.
Figure 3C:
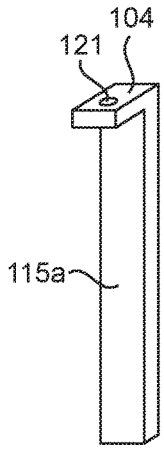
FIG. 3C is an illustration of an exemplary privacy fence back side showing an installed bottom privacy tip.
Figure 3C:
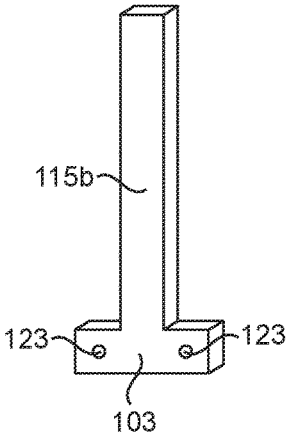
Figure 3C:
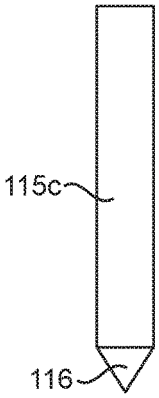
Figure 3C:
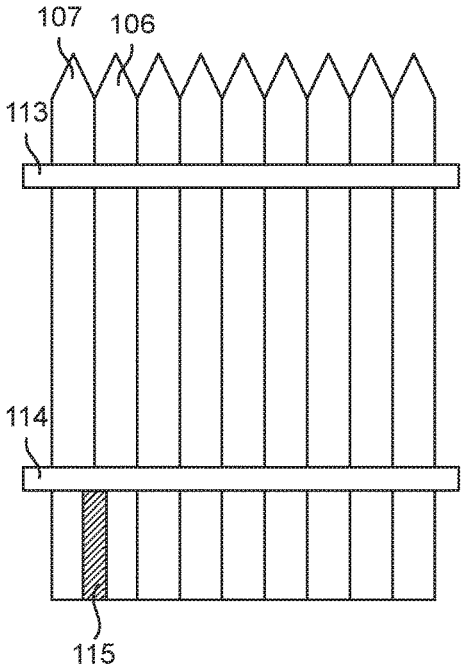

FIG. 3A is an illustration of an exemplary bottom privacy tip without a fastener mechanism. The bottom privacy tip 115 may be comprised of plastic, vinyl, aluminum, steel, wood, or any other suitable material known in the art. The top privacy tip 115 may be of a suitable thickness, width and length suitable to cover the gap created between two pickets within a privacy fence, as shown in FIG. 3C. The bottom privacy tip 115 may have no fastener mechanism, and may be suitable for inserting at a downward angle (i.e. wedged) between the inner gap created in between the vertical pickets and the horizontal bottom beam 114 as shown in FIG. 3C. Alternatively, the bottom privacy tip may be fastened onto at least one horizontal beam or at least one picket by means of adhesive along its surface area in order to be affixed into position.

FIG. 3B1 is an illustration of an exemplary bottom privacy tip with an L-bracket fastener mechanism. The bottom privacy tip with an L-bracket fastener mechanism 115*a* may have a L-bracket 104 integrated along its top portion to allow for a nail, screw, or suitable alternative to be inserted into the L-bracket hole 121 within the L-bracket 104. The L-bracket 104 is suitable to be affixed to the horizontal bottom beam 114, as shown in FIG. 3C, to hold the top privacy tip with a L-bracket 115*a* in place.

FIG. 3B2 is an illustration of an exemplary bottom privacy tip with a T-bracket fastener mechanism. The bottom privacy tip with a T-bracket fastener mechanism 115*b* may have a T-bracket 103 integrated along its top portion to allow for a nail, screw, or suitable alternative to be inserted into the T-bracket holes 123 within the T-bracket 103. The T-bracket is suitable to be affixed to the right picket 106 and left picket 106, as shown in FIG. 3C, to hold the bottom privacy tip with T-bracket 115*b* in place.

FIG. 3B3 is an illustration of an exemplary bottom privacy tip with ground stake fastener mechanism. The bottom privacy tip with ground stake fastener mechanism

115*c* may have a ground stake 116 integrated along its bottom portion to allow for the ground stage 116 to be forced downward into the ground to keep the bottom privacy tip with ground stake 115*c* in place. The bottom privacy tip with ground stake 115*c* is intended to cover a gap in between a right privacy fence 106 and left privacy fence.

FIG. 3C is an illustration of an exemplary privacy fence back side showing an installed bottom privacy tip. The bottom privacy tip 115 may be installed between two parallel pickets and along a bottom side of a bottom horizontal beam 114. In one embodiment, a right privacy picket 106 and a left privacy picket 107, when installed, have a gap created between them, that can be covered by the bottom privacy tip 115, wherein the bottom privacy tip 115 can be wedged at an angle along the bottom of the horizontal bottom beam 114, to hold the bottom privacy tip 115 in place.

Figure 3D:
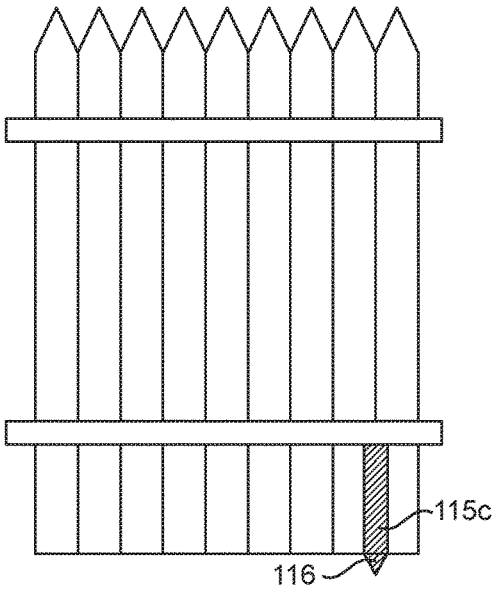
FIG. 3D is an illustration of an exemplary privacy fence back side showing an installed bottom privacy tip mounted onto the ground using the ground stake fastener mechanism.

FIG. 3D is an illustration of an exemplary privacy fence back side showing an installed bottom privacy tip mounted onto the ground using the ground stake fastener mechanism. The bottom privacy tip 115*c* may be installed between two parallel pickets and mounted into the ground. In one embodiment, a right privacy picket 106 and a left privacy picket 107, when installed, have a gap created between them, that can be covered by the installation of a bottom privacy tip with a ground stake 115*c*, wherein the bottom privacy tip with a ground stake 115*c* can be mounted into the ground when the ground stake 116 is forced downward into the ground to keep the bottom privacy tip 115*c* in place.

Figure 4D:
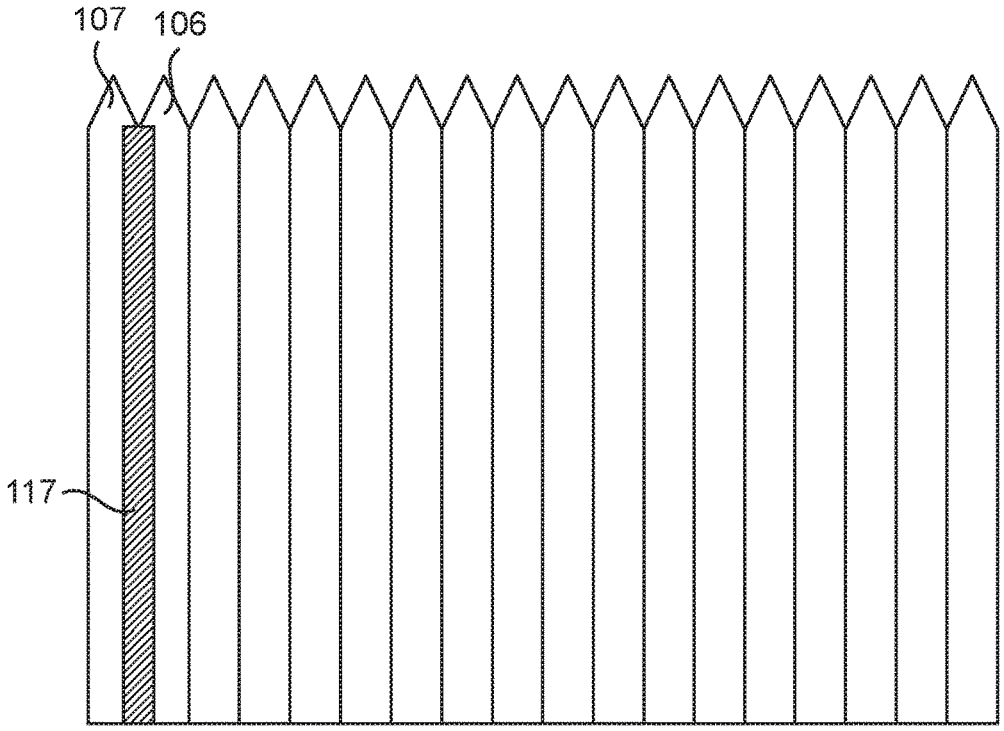
FIG. 4D is an illustration of an exemplary privacy fence front side showing an installed single piece privacy strip.

FIG. 4 is an illustration of an exemplary single piece privacy strip without a fastener mechanism. The single piece privacy strip 117 may be comprised of plastic, vinyl, aluminum, steel, wood, or any other suitable material known in the art. The single piece privacy strip 117 may be of a suitable thickness, width and length suitable to cover the gap created between two pickets within a privacy fence, as shown in FIG. 4D. The single piece privacy strip 117 may have no fastener mechanism, and may be suitable for affixing in between the two horizontal beams, as shown in FIG. 4D. Alternatively, the single piece privacy strip may be fastened onto at least one horizontal beam or at least one picket by means of adhesive along its surface area in order to be affixed into position.

FIG. 4B1 is an illustration of an exemplary single piece privacy strip with an side bracket fastener mechanism. The single piece privacy strip with a side bracket fastener mechanism 117*a* may have a side bracket 125 integrated along its bottom or top portion to allow for a nail, screw, or suitable alternative to be inserted into the side bracket hole 126 within the side bracket 125. The single piece privacy strip may be configured to be installed to cover the gap created between two neighboring pickets, wherein the side bracket can be affixed to at least one of the two neighboring pickets.

FIG. 4B2 is an illustration of an exemplary single piece privacy strip with a T-bracket fastener mechanism. The single piece privacy strip with an T-bracket fastener mechanism 112*b* may have a T-bracket 103 integrated along its bottom or top portion to allow for a nail, screw, or suitable alternative to be inserted into the T-bracket hole 123 within the T-bracket 103. The T-bracket 103 is suitable to be affixed to the right privacy picket 106 and the left privacy picket 107, as shown in FIG. 4D, to hold the single piece privacy strip with a T-bracket 117*b* in place.

FIG. 4C1 is an illustration of an exemplary single piece privacy strip with two T-bracket fastener mechanisms. The single piece privacy strip with a dual T-bracket fastener mechanism 117*c* may have a T-bracket 103 integrated along its bottom and another T-bracket integrated along its top portion to allow for a nail, screw, or suitable alternative to be inserted into the T-bracket hole 123. The top T-bracket may be suitable to affixed to the right privacy picket 106 and the left privacy picket 107. Similarly, the bottom T-bracket may be suitable to be affixed to the right privacy picket and the left privacy picket 107.

FIG. 4C2 is an illustration of an exemplary single piece privacy strip with two side bracket fastener mechanisms. The single piece privacy strip with a dual side bracket fastener mechanism 117*d* may have a side bracket 125 integrated along its bottom and another side bracket 125 integrated along its top portion to allow for a nail, screw, or suitable alternative to be inserted into the side bracket hole 126. The top side bracket 125 may be suitable to affixed to the right privacy picket 106 or the left privacy picket 107. Similarly, the bottom side bracket 125 may be suitable to be affixed to either the right privacy picket 106 or the left privacy picket 107.

FIG. 4D is an illustration of an exemplary privacy fence front side showing an installed single piece privacy strip. In one embodiment, the single piece privacy strip 117 is intended to be used for the front side of an exemplary privacy fence wherein the horizontal beams are not present, wherein the single piece privacy strip can be maintained from top to bottom, as a single covering, to cover the gap created between a right privacy picket 106 and a left privacy picket 107.

Figure 5:
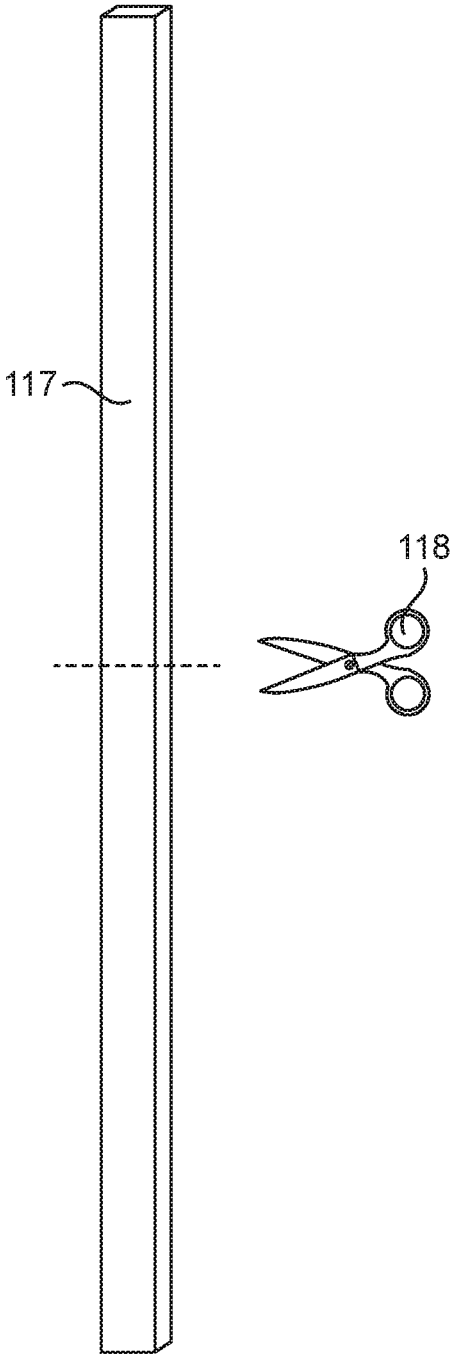
FIG. 5 is an illustration of an exemplary cuttable single piece privacy strip.

FIG. 5 is an illustration of an exemplary cuttable single piece privacy strip. In one embodiment of the invention, the single piece privacy strip 117 may be cut by a cutting mechanism 118 (i.e. scissors, blades, etc.) in order to be customized and tailored to a specific privacy fence for which the end user intends to apply the single piece privacy strip 117. The single piece privacy strip 117 may be made of materials (such as plastic or vinyl, or other materials) that allow for cutting or sizing adjustments. Moreover, the top privacy tip, the privacy strip, and the bottom privacy tip may be made of materials that allow for cutting and size adjustments, to fit the end users desired needs.

Figure 6:
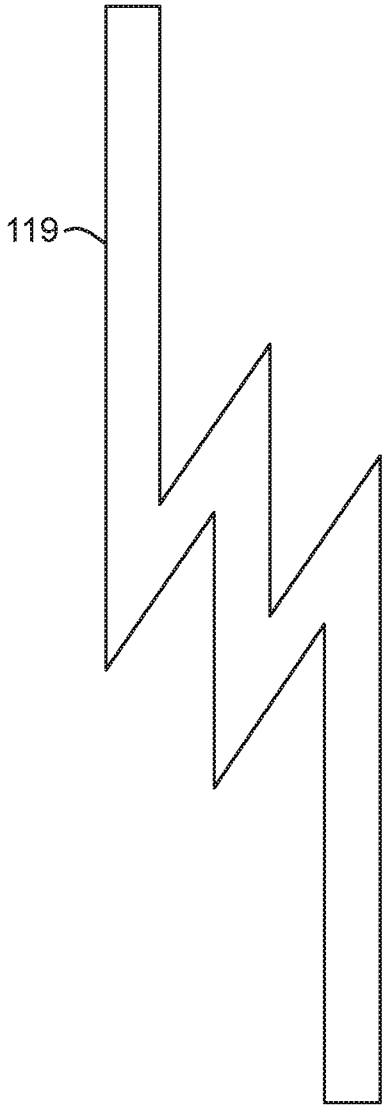
FIG. 6 is an illustration of an exemplary foldable single piece privacy strip.

FIG. 6 is an illustration of an exemplary foldable single piece privacy strip. In one embodiment of the invention, a foldable single piece privacy strip 119 that can collapse or fold, on either end, to allow users to customize and tailor the length. Moreover, the top privacy tip, the privacy strip and the bottom privacy tip may also be designed to be collapsible, as shown in this figure, to allow for adjustments in sizing to fit the needs of end users.

Figure 7:
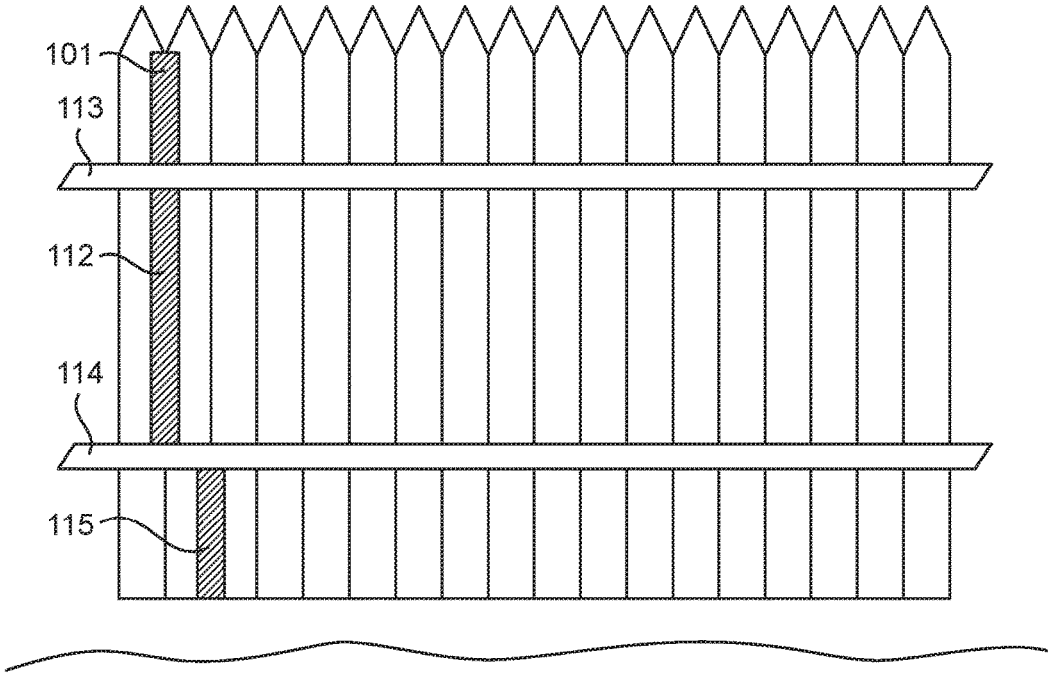
FIG. 7 is an illustration of a backside of a privacy fence with a top privacy tip, a privacy strip, and a bottom privacy tip shown, as installed.

FIG. 7 is an illustration of a backside of a privacy fence with a top privacy tip, a privacy strip, and a bottom privacy tip shown, as installed. In one embodiment of the invention, a traditional privacy fence back side with a plurality of parallel pickets arranged vertically in a row, with a top horizontal beam 113 and a bottom horizontal beam 114, shown with the installation of a top privacy tip 101, a privacy strip 112, and a bottom privacy tip 115.

Figure 8:
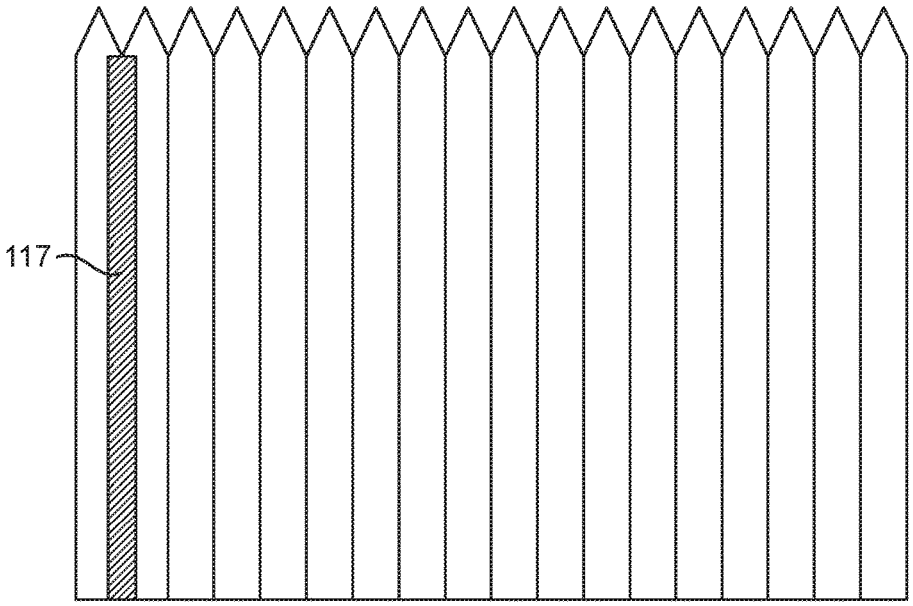
FIG. 8 is an illustration of a frontside of a privacy fence with a single piece privacy strip installed.

FIG. 8 is an illustration of a frontside of a privacy fence with a single piece privacy strip installed. In one embodiment of the invention, a traditional privacy fence front side with a plurality of parallel pickets arranged vertically in a row, shown with the installation of a single piece privacy strip 117.

The invention claimed is:

1. A privacy fencing accessory apparatus, comprising:

a privacy strip configured to cover a middle viewable opening between a first fence board and an adjacent second fence board within an installed privacy fence;

wherein the privacy strip is configured to cover the middle viewable opening within the installed privacy fence and affixed along a backside of the installed privacy fence in between a top stringer and a bottom stringer, and covering a right side of the first fence board and a left side of the adjacent second fence board, wherein the privacy strip is affixed along a backside of the installed privacy fence by a fastener means arranged along a top side of the privacy strip which is configured to attach to a bottom surface of the top stringer, wherein the privacy strip is affixed along a backside of the installed privacy fence by a fastener means arranged along a bottom side of the privacy strip which is configured to attach to a top surface of the bottom stringer, wherein the privacy strip is affixed along a backside of the installed privacy fence by a fastener means arranged along a bottom side of the privacy strip which is configured to attach to either the first fence board or the adjacent second fence board.

2. A privacy fencing accessory apparatus, comprising:

a privacy strip configured to cover a middle viewable opening between a first fence board and an adjacent second fence board within an installed privacy fence;

wherein the privacy strip is configured to cover the middle viewable opening within the installed privacy fence and affixed along a backside of the installed privacy fence in between a top stringer and a bottom stringer, and covering a right side of the first fence board and a left side of the adjacent second fence board;

a top privacy tip configured to cover a top viewable opening between the first fence board and the adjacent second fence board within the installed privacy fence, wherein the top privacy tip is configured to cover the top viewable opening within the installed privacy fence and is affixed along a backside of the installed privacy fence above the top stringer and covering the right side of the first fence board and the left side of the adjacent second fence board, wherein the top privacy tip is affixed along a backside of the installed privacy fence by a fastener means arranged along a bottom side of the top privacy tip which is configured to attach to a top surface of the top stringer wherein the top privacy tip is affixed along a backside of the installed privacy fence by a fastener means arranged along a bottom side of the top privacy tip which is configured to attach to either the first fence board or the adjacent second fence board.

3. A privacy fencing accessory apparatus, comprising:

a privacy strip configured to cover a middle viewable opening between a first fence board and an adjacent second fence board within an installed privacy fence;

wherein the privacy strip is configured to cover the middle viewable opening within the installed privacy fence and affixed along a backside of the installed privacy fence in between a top stringer and a bottom stringer, and covering a right side of the first fence board and a left side of the adjacent second fence board;

a bottom privacy tip configured to cover a bottom viewable opening between the first fence board and the adjacent second fence board within the installed privacy fence;

wherein the bottom privacy tip is configured to cover the bottom viewable opening within the installed privacy fence and is affixed along a backside of the installed privacy fence below the bottom stringer and covering the right side of the first fence board and the left side of the adjacent second fence board, wherein the bottom privacy tip is affixed along a backside of the installed privacy fence by a fastener means arranged along a top side of the bottom privacy tip which is configured to attach to a bottom surface of the bottom stringer, wherein the bottom privacy tip is affixed along a backside of the installed privacy fence by a fastener means arranged along a top side of the bottom privacy tip which is configured to attach to either the first fence board or the adjacent second fence board.

* * * * *